US011268513B2

(12) United States Patent
Hebrard et al.

(10) Patent No.: US 11,268,513 B2
(45) Date of Patent: Mar. 8, 2022

(54) SCREW-TYPE COMPRESSOR FOR A UTILITY VEHICLE

(71) Applicant: KNORR-BREMSE System fuer Nutzfahrzeuge GmbH, Munich (DE)

(72) Inventors: Gilles Hebrard, Munich (DE); Jean-Baptiste Marescot, Munich (DE); Joerg Mellar, Munich (DE); Thomas Weinhold, Munich (DE)

(73) Assignee: KNORR-BREMSE Systeme fuer Nutzfahrzeuge GmbH, Munich (DE)

( * ) Notice: Subject to any disclaimer, the term of this patent is extended or adjusted under 35 U.S.C. 154(b) by 254 days.

(21) Appl. No.: 16/333,554

(22) PCT Filed: Sep. 19, 2017

(86) PCT No.: PCT/EP2017/073550
§ 371 (c)(1),
(2) Date: Mar. 24, 2020

(87) PCT Pub. No.: WO2018/054865
PCT Pub. Date: Mar. 29, 2018

(65) Prior Publication Data

US 2021/0010475 A1 Jan. 14, 2021

(30) Foreign Application Priority Data

Sep. 21, 2016 (DE) ..... 10 2016 011 393.6

(51) Int. Cl.
*F04C 29/02* (2006.01)
*F04C 18/16* (2006.01)

(52) U.S. Cl.
CPC ..... *F04C 29/026* (2013.01); *F04C 18/16* (2013.01); *F04C 2210/1005* (2013.01);
(Continued)

(58) Field of Classification Search
CPC ..... F04C 18/16; F04C 23/008; F04C 27/008; F04C 29/026; F04C 29/028; F04C 29/04;
(Continued)

(56) References Cited

U.S. PATENT DOCUMENTS 3,776,668 A 12/1973 Abendschein
4,174,196 A 11/1979 Mori et al.
(Continued)

FOREIGN PATENT DOCUMENTS

BE 857230 A 11/1977
CN 1301944 A 7/2001
(Continued)

OTHER PUBLICATIONS

Korean-language Office Action issued in Korean Application No. 10-2019-7010904 dated Jun. 2, 2020 with English translation (12 pages).
(Continued)

*Primary Examiner* — Audrey B. Walter
*Assistant Examiner* — Dapinder Singh
(74) *Attorney, Agent, or Firm* — Crowell & Moring LLP

(57) ABSTRACT

A screw compressor for a utility vehicle has at least one housing with at least one housing cover and with at least one rotor housing, at least one baffle plate and at least one seal. In the assembled state, an oil sump is present in the housing, wherein, with regard to the assembled state, the seal is arranged between housing cover and rotor housing and projects out of the oil sump. The seal at least partially separates the interior of the housing cover from the interior of the rotor housing. With regard to the assembled state, in the case of a substantially horizontal orientation of the screw-type compressor and in the case of a substantially
(Continued)

horizontal orientation of the oil sump, the baffle plate is oriented substantially parallel to the upper level of the oil sump.

15 Claims, 2 Drawing Sheets

(52) U.S. Cl.
CPC .... *F04C 2240/30* (2013.01); *F04C 2240/809* (2013.01); *F05B 2210/16* (2013.01); *F05B 2240/57* (2013.01)

(58) Field of Classification Search
CPC ..... F04C 2240/30; F04C 2240/40; F04C 2240/809; F04C 2210/1005; F04C 2210/221; F01C 27/007; F05B 2210/16; F05B 2210/22; F05B 2240/57; F05B 2260/98
See application file for complete search history.

(56) References Cited

U.S. PATENT DOCUMENTS

| | | | | |
|---|---|---|---|---|
| 4,478,054 | A | 10/1984 | Shaw et al. | |
| 4,780,061 | A | 10/1988 | Butterworth | |
| 5,199,858 | A | 4/1993 | Tsuboi et al. | |
| 6,237,362 | B1 * | 5/2001 | Jang | F04B 27/109 62/469 |
| 6,769,890 | B2 * | 8/2004 | Vigano' | F04C 18/086 418/178 |
| 7,234,926 | B2 * | 6/2007 | Sowards | F04C 18/023 417/295 |
| 7,891,955 | B2 * | 2/2011 | Picouet | F04B 49/03 417/213 |
| 2002/0054823 | A1 | 5/2002 | Hida et al. | |
| 2003/0175140 | A1 | 9/2003 | Yamanaka et al. | |
| 2010/0247366 | A1 | 9/2010 | Kato et al. | |
| 2013/0108497 | A1 | 5/2013 | Koeck | |

FOREIGN PATENT DOCUMENTS

| | | | |
|---|---|---|---|
| CN | 1353249 | A | 6/2002 |
| CN | 101846075 | A | 9/2010 |
| CN | 103003569 | A | 3/2013 |
| DE | 2 307 240 | A | 8/1973 |
| DE | 196 21 603 | A1 | 12/1997 |
| DE | 10 2010 015 147 | A1 | 10/2011 |
| EP | 2 538 118 | A1 | 12/2012 |
| JP | 2002-295383 | | 10/2002 |
| JP | 2004-176701 | A | 6/2004 |
| KR | 10-0318418 | B1 | 12/2001 |
| KR | 2003-0034807 | A | 5/2003 |

OTHER PUBLICATIONS

International Search Report (PCT/ISA/210) issued in PCT Application No. PCT/EP2017/073550 dated Dec. 22, 2017 with English translation (six (6) pages).
German-language Written Opinion (PCT/ISA/237) issued in PCT Application No. PCT/EP2017/073550 dated Dec. 22, 2017 (six (6) pages).
German-language Office Action issued in counterpart German Application No. 10 2016 011 393.6 dated Jul. 27, 2017 (five (5) pages).
International Preliminary Report on Patentability (PCT/IB/326 & PCT/IB/373) issued in PCT Application No. PCT/EP2017/073550 dated Apr. 4, 2019, including English translation of document C2 (German-language Written Opinion (PCT/ISA/237) previously filed on Mar. 14, 2019) (eight (8) pages).
Chinese-language Office Action issued in counterpart Chinese Application No. 201780068602.2 dated Nov. 28, 2019 with partial English translation (11 pages).

* cited by examiner

SCREW-TYPE COMPRESSOR FOR A UTILITY VEHICLE

BACKGROUND AND SUMMARY OF THE INVENTION

The present invention relates to a screw compressor for a utility vehicle having at least one housing with at least one housing body and with at least one rotor housing, as well as at least one baffle plate and at least one seal, wherein, in the assembled state, an oil sump is present in the housing.

Screw compressors for utility vehicles are already known from the prior art. Such screw compressors are used to provide the compressed air required for the brake system of the utility vehicle, for example.

In this context, in particular oil-filled compressors, in particular also screw compressors, are known, in the case of which it is necessary to regulate the oil temperature. This is generally realized by virtue of an external oil cooler being provided which is connected to the oil-filled compressor and to the oil circuit via a thermostat valve. Here, the oil cooler is a heat exchanger which has two mutually separate circuits, wherein the first circuit is provided for the hot liquid, that is to say the compressor oil, and the second circuit is provided for the cooling liquid. As cooling liquid, use may for example be made of air, water mixtures with an antifreeze, or another oil.

This oil cooler must then be connected to the compressor oil circuit by means of pipes or hoses, and the oil circuit must be safeguarded against leakage.

This external volume must furthermore be filled with oil, such that the total quantity of oil is also increased. The system inertia is thus increased. Furthermore, the oil cooler must be mechanically accommodated and fastened, either by means of brackets situated in the surroundings or by means of a separate bracket, which necessitates additional fastening means and also structural space.

U.S. Pat. No. 4,780,061 has already disclosed a screw compressor with an integrated oil cooling arrangement.

It is the object of the present invention to advantageously further develop a screw compressor for a utility vehicle of the type mentioned in the introduction, in particular such that the removal of oil from the compressed air can be improved and simplified.

This object is achieved according to the invention by a screw compressor for a utility vehicle whereby the screw compressor for the utility vehicle is equipped with at least one housing with at least one housing body and with at least one rotor housing, as well as at least one baffle plate and at least one seal. In the assembled state, an oil sump is present in the housing, wherein, in relation to the assembled state, the seal is arranged between housing body and rotor housing and projects out of the oil sump. The seal at least partially separates the interior of the housing body and the interior of the rotor housing from one another. In relation to the assembled state, in the case of a substantially horizontal orientation of the screw compressor and in the case of a substantially horizontal orientation of the oil sump, the baffle plate is oriented substantially parallel to the upper level of the oil sump.

The housing may be of two-part or multi-part form. The multi-part form is produced in particular by virtue of the housing being assembled from a housing body and a rotor housing.

The invention is based on the underlying concept of restricting the movement of the oil within the screw compressor through the arrangement of corresponding elements which are partially permeable to the oil, such as a seal and the baffle plate. It is achieved in this way that, even during driving operation, the oil sump moves "below" the baffle plate and that even horizontal surging movements can be prevented by the seal projecting out of the oil sump. In this way, the introduction of oil into corresponding elements for the removal of oil from the compressed air, such as for example an air oil separator or the like, can be reduced.

The baffle plate may have at least one, in particular multiple, oil passage opening(s). Such oil passage openings may for example be formed as elongate rounded slots. In this way, it is made possible for oil from the oil sump to be able to rise for example in the form of oil vapor or oil aerosol and be distributed in the interior of the screw compressor.

Provision may furthermore be made whereby the baffle plate and the seal divide the interior of the screw compressor into multiple interconnected compartments. It is hereby made possible for oil to be retained in the corresponding compartments in the interior of the screw compressor or for oil vapor to be substantially provided in particular compartments and the oil sump or a liquid oil to be provided in particular compartments.

Provision may furthermore be made whereby the seal divides the housing interior asymmetrically into at least one first region and at least one second region, wherein the first region is smaller than the second region. In this way, it is for example possible to achieve that particular regions which are to be supplied to a greater extent with small oil droplets, oil aerosols or oil vapors are reached more easily, and the first region, which is formed so as to be smaller than the second region, is supplied to a lesser extent with small oil droplets, oil aerosols or oil vapors.

The screw compressor may have an air oil separator and an air oil separator inflow, wherein the air oil separator inflow opens into the housing interior of the screw compressor, and wherein the passage openings of the seal are arranged in the vicinity of the air oil separator inflow. In this way, it is made possible for the air oil separator to be of relatively small form. In particular, it is made possible for the introduction of oil into the air oil separator to be limited by means of the design and arrangement of the seal. By virtue of the fact that the passage openings of the seal are arranged in the vicinity of the air oil separator inflow, the introduction of oil into the air oil separator inflow and thus into the air oil separator is already reduced.

Provision may furthermore be made for the air oil separator inflow to be formed in the housing cover. It is thus made easier to manufacture the air oil separator inflow. Also, in this way, the arrangement of air oil separator inflow and seal, which in the assembled state is situated between housing cover and housing body, can be adjusted relatively easily.

In particular, provision may be made whereby the air oil separator inflow opens into the first region of the housing interior. Consequently, the oil separator inflow opens out in that region of the housing interior which is formed so as to be smaller than the second region, wherein the first and the second region are separated from one another by the seal.

Provision may furthermore be made whereby, in relation to the assembled state, in the case of a substantially horizontal orientation of the screw compressor and in the case of a substantially horizontal orientation of the oil sump, the seal is arranged substantially vertically. It is thus made possible to simplify the return of the oil, which collects at the seal, into the oil sump. Owing to gravitational force, said oil can easily flow back into the oil sump again.

The passage openings may be of substantially round, in particular circular form. This design of the passage openings permits simple manufacture and production of the seal. However, in this context, any other shape of the passage openings is also possible. This can yield further advantages, for example that the limitation of the displacement of oil owing to small oil droplets, oil vapors or oil aerosols is improved.

Provision may furthermore be made whereby the seal is formed at least in regions, with the regions situated in the housing interior in the assembled state, as a perforated plate. This permits simple manufacture and production of the seal. The stability of the seal can also be influenced and positively configured in this way. By means of a uniform arrangement of the holes in the regions in which the seal is formed as a perforated plate, it is possible to provide a good area of passage openings without weakening the seal as a whole.

The seal may furthermore have a baffle plate passage opening. It is conceivable in particular for the baffle plate passage opening to be formed so as to be situated, in the assembled state, approximately at the height of the level of the surface of the oil sump. The baffle plate and the seal may be arranged substantially perpendicular to one another. Through the formation of the baffle plate passage opening, a simple design and assembly of seal and baffle plate is made possible overall.

The provision of a baffle plate makes it possible for major parts of the oil sump to be retained in the lower-lying regions of the screw compressor even during the operation of the screw compressor and in particular during driving operation of the utility vehicle, without the need for surging of the oil back and forth to be compensated.

The seal may have screw bolt passage openings which are provided for the passage of screw bolts by means of which the seal, housing body and rotor housing are screwed together. Simple, secure and reliable installation of the seal between housing body and rotor housing is made possible in this way.

Furthermore, provision may be made for the seal and the baffle plate to be plugged one into the other. This facilitates the assembly and manufacture of the screw compressor and of the seal and of the baffle plate.

The seal and the baffle plate may be arranged crosswise with respect to one another. This permits a simple and clear definition of compartments and also of the corresponding regions in the interior of the screw compressor.

Provision may furthermore be made for the seal and the baffle plate to be arranged substantially perpendicular to one another. By means of this arrangement, an expedient partitioning is realized in the interior space of the screw compressor. Furthermore, such an arrangement is expedient for utilizing the seal in combination with the baffle plate as a vertical "baffle panel" in order to reliably prevent horizontal surging movements, to generate the greatest possible obstructive action for this purpose, and at the same time to permit an outflow along the seal in the direction of the oil sump.

Further details and advantages of the invention will now be discussed in more detail on the basis of an exemplary embodiment illustrated in the drawings.

DETAILED DESCRIPTION OF THE DRAWINGS

Figure 1:
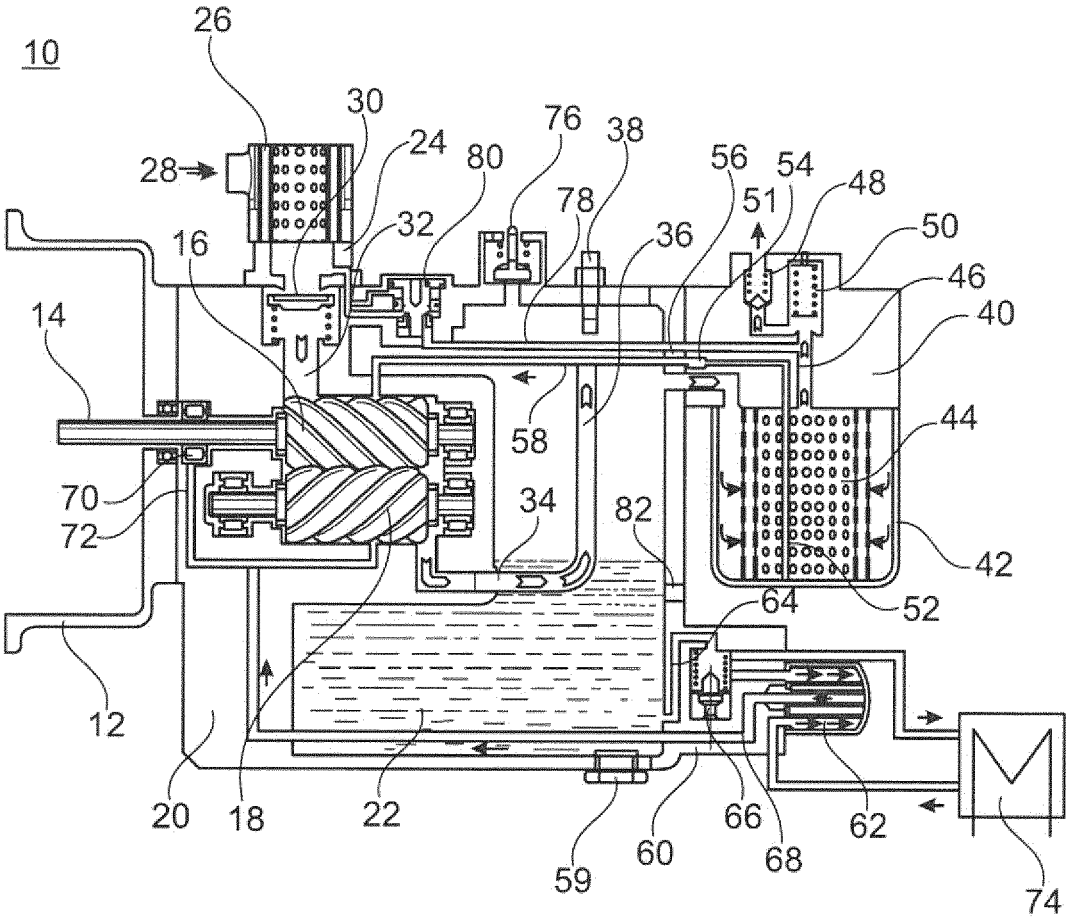
FIG. 1 shows a schematic sectional drawing through a screw compressor according to the invention.

FIG. 1 shows, in a schematic sectional illustration, a screw compressor 10 in the context of an exemplary embodiment of the present invention.

The screw compressor 10 has a fastening flange 12 for the mechanical fastening of the screw compressor 10 to an electric motor (not shown in any more detail here).

What is shown, however, is the input shaft 14, by which the torque from the electric motor is transmitted to one of the two screws 16 and 18, specifically the screw 16.

The screw 18 meshes with the screw 16 and is driven by means of the latter.

The screw compressor 10 has a housing 20 in which the main components of the screw compressor 10 are accommodated.

The housing 20 is filled with oil 22.

At the air inlet side, an inlet connector 24 is provided on the housing 20 of the screw compressor 10. The inlet connector 24 is in this case designed such that an air filter 26 is arranged at said inlet connector. Furthermore, an air inlet 28 is provided radially on the air inlet connector 24.

In the region between the inlet connector 24 and the point at which the inlet connector 24 joins to the housing 20, there is provided a spring-loaded valve insert 30, which is designed here as an axial seal.

This valve insert 30 serves as a check valve.

Downstream of the valve insert 30, there is provided an air feed channel 32 which feeds the air to the two screws 16, 18.

At the outlet side of the two screws 16, 18, there is provided an air outlet pipe 34 with a riser line 36.

In the region of the end of the riser line 36, there is provided a temperature sensor 38 by means of which the oil temperature can be monitored.

Also provided in the air outlet region is a holder 40 for an air oil separator 42.

In the assembled state, the holder 40 for the air oil separator has the air oil separator 42 in the region facing toward the base (as also shown in FIG. 1).

Also provided, in the interior of the air oil separator 42, is a corresponding filter screen or known filter and oil separation devices 44, which will not be specified in any more detail.

In the central upper region in relation to the assembled and operationally ready state (that is to say as shown in FIG. 1), the holder for the air oil separator 42 has an air outlet opening 46 which leads to a check valve 48 and a minimum pressure valve 50. The check valve 48 and the minimum pressure valve 50 may also be formed in one common combined valve.

The air outlet 51 is provided downstream of the check valve 48.

The air outlet 51 is generally connected to correspondingly known compressed-air consumers.

In order for the oil 22 that is situated and separated off in the air oil separator 42 to be returned into the housing 20 again, a riser line 52 is provided which has a filter and check valve 54 at the outlet of the holder 40 for the air oil separator 42 at the transition into the housing 20.

A nozzle 56 is provided, downstream of the filter and check valve 54, in a housing bore. The oil return line 58 leads back into approximately the central region of the screw 16 or of the screw 18 in order to feed oil 22 thereto again.

An oil drain screw 59 is provided in the base region, in the assembled state, of the housing 20. By means of the oil drain screw 59, a corresponding oil outflow opening can be opened, via which the oil 22 can be drained.

Also provided in the lower region of the housing 20 is the attachment piece 60 to which the oil filter 62 is fastened. Via an oil filter inlet channel 64, which is arranged in the housing 20, the oil 22 is conducted firstly to a thermostat valve 66.

Instead of the thermostat valve 66, it is possible for an open-loop and/or closed-loop control device to be provided by means of which the oil temperature of the oil 22 situated in the housing 20 can be monitored and set to a setpoint value.

Downstream of the thermostat valve 66, there is then the oil inlet of the oil filter 62, which, via a central return line 68, conducts the oil 22 back to the screw 18 or to the screw 16 again, and also to the oil-lubricated bearing 70 of the shaft 14. Also provided in the region of the bearing 70 is a nozzle 72, which is provided in the housing 20 in conjunction with the return line 68.

The cooler 74 is connected to the attachment piece 60.

In the upper region of the housing 20 (in relation to the assembled state), there is situated a safety valve 76, by means of which an excessively high pressure in the housing 20 can be dissipated.

Upstream of the minimum pressure valve 50, there is situated a bypass line 78, which leads to a relief valve 80. Via said relief valve 80, which is activated by means of a connection to the air feed 32, air can be returned into the region of the air inlet 28. In this region, there may be provided a ventilation valve (not shown in any more detail) and also a nozzle (diameter constriction of the feeding line).

Furthermore, approximately at the level of the line 34, an oil level sensor 82 may be provided in the outer wall of the housing 20. Said oil level sensor 82 may for example be an optical sensor, and may be designed and configured such that, on the basis of the sensor signal, it can be identified whether the oil level during operation is above the oil level sensor 82 or whether the oil level sensor 82 is exposed, and thus the oil level has correspondingly fallen.

In conjunction with this monitoring, it is also possible for an alarm unit to be provided which outputs or transmits a corresponding error message or warning message to the user of the system.

The function of the screw compressor 10 shown in FIG. 1 is as follows.

Air is fed via the air inlet 28 and passes via the check valve 30 to the screws 16, 18, where the air is compressed. The compressed air-oil mixture, which, having been compressed by a factor of between 5 and 16 downstream of the screws 16 and 18, rises through the outlet line 34 via the riser pipe 36, is blown directly onto the temperature sensor 38.

The air, which still partially carries oil particles, is then conducted via the holder 40 into the air oil separator 42 and, if the corresponding minimum pressure is attained, passes into the air outlet line 51.

The oil 22 situated in the housing 20 is kept at operating temperature via the oil filter 62 and possibly via the heat exchanger 74.

If no cooling is necessary, the heat exchanger 74 is not used and is also not activated.

The corresponding activation is performed by means of the thermostat valve 66. After purification in the oil filter 62, oil is fed via the line 68 to the screw 18 or to the screw 16, and also to the bearing 70. The screw 16 or the screw 18 is supplied with oil 22 via the return line 52, 58, and the purification of the oil 22 takes place here in the air oil separator 42.

By means of the electric motor (not shown in any more detail), which transmits its torque via the shaft 14 to the screw 16, which in turn meshes with the screw 18, the screws 16 and 18 of the screw compressor 10 are driven.

By means of the relief valve 80 (not shown in any more detail), it is ensured that the high pressure that prevails for example at the outlet side of the screws 16, 18 in the operational state cannot be enclosed in the region of the feed line 32, and that, instead, in particular during the start-up of the compressor, there is always a low inlet pressure, in particular atmospheric pressure, prevailing in the region of the feed line 32. Otherwise, upon a start-up of the compressor, a very high pressure would initially be generated at the outlet side of the screws 16 and 18, which would overload the drive motor.

Figure 2:
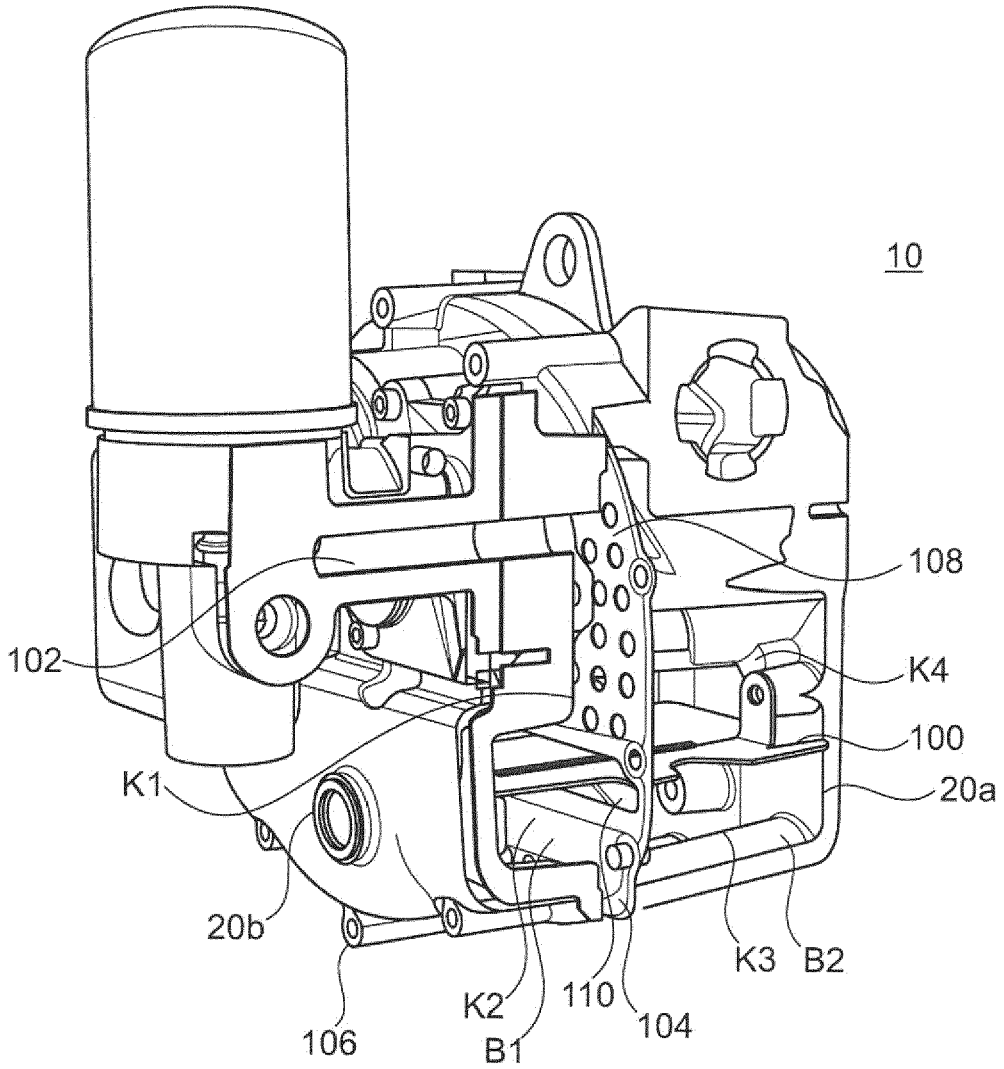
FIG. 2 shows a perspective sectional illustration through the screw compressor with a view of the housing interior of the screw compressor.

FIG. 2 shows, in a perspective schematic illustration, the screw compressor 10 as per FIG. 1 in a sectional illustration with a view of the interior of the housing 20 of the screw compressor 10.

Arranged in the interior of the housing 20 is a baffle plate 100 which is situated substantially at the height of the upper level of the oil sump of the oil 22. The assembled state and a horizontal arrangement of the upper level of the oil sump are assumed here.

The housing 20 has a housing cover **20*b* and a rotor housing 20*a***.

An air oil separator inflow 102, which is connected to the air oil separator 42, is situated in the housing cover **20*b***.

Between the housing cover **20*b* and the rotor housing 20*a*, there is provided a seal 104 which runs in encircling fashion between the edges of the housing cover 20*b* and rotor housing 20*a*** in the assembled state and which is clamped and screwed with sealing action between these.

For this purpose, the seal 104 has screw bolt passage openings 106 through which corresponding screw connections by means of screw bolts can be led, such that seal 104, housing cover **20*b* and rotor housing 20*a*** can be screwed together, and are screwed together in the assembled state.

In relation to the assembled state of the screw compressor 10, the seal 104 is arranged between housing cover **20*b* and rotor housing 20*a* and projects out of the oil sump of the oil 22**.

The seal 104 is formed as a sealing panel and has multiple passage openings 108.

The passage openings 108 are of circular form and are arranged so as to be offset relative to one another in a regular pattern in the manner of a perforated plate in that region of the seal 104 which is situated above the oil sump.

The seal 104 divides the housing interior asymmetrically into at least a first region B1, which relates substantially to the internal regions of the housing cover **20*b*, and a second region B2, which relates substantially to the interior of the rest of the housing 20, that is to say of the rotor housing 20*a*. Here, the first region B1 is smaller than the second region B2**.

The air oil separator inflow 102 opens into the first region B1 and is situated in the vicinity of the passage openings 108 of the seal 104.

As can also be seen from FIG. 2, in relation to the assembled state, in the case of a substantially horizontal orientation of the screw compressor 10 and in the case of a substantially horizontal orientation of the oil sump of the oil 22, the seal 104 is arranged vertically.

Furthermore, at the height of the upper level of the oil sump of the oil 22, the seal 104 has a passage opening 110 for the baffle plate 100.

In the exemplary embodiment shown in FIG. 2, the baffle plate 100 has multiple oil passage openings, which are formed as elongate slots.

The baffle plate 100 and the seal 104 divide the interior of the screw compressor 10 into multiple interconnected compartments K1, K2, K3 and K4.

Here, the compartments K2 and K3 are those compartments K2 and K3 in which the oil sump of the oil 22 is situated. The compartment K1 is situated in the region B1, and the compartment K4 is situated in the region B2.

The seal 104 and the baffle plate 100 are plugged one into the other and are arranged crosswise with respect to one another. Here, the seal 104 and the baffle plate 100 are arranged substantially perpendicular to one another.

The function of the seal 104 and of its passage openings 108 can be described as follows.

During operation, the screws 16 and 18 are lubricated by pressurized oil of the oil 22 from the oil sump, such that oil vapors, small oil droplets or oil aerosols are present above the upper level of the oil sump. Further oil movements are forced by the driving movements of the utility vehicle, such that the movement of the oil 22 and the movement capabilities of the oil 22 are restricted by means of the baffle plate 100 and also the seal 104. At the same time, however, by means of the passage openings 108 both in the baffle plate 100 and in the seal 104, it is achieved that sufficient oil 22 in the form of small oil droplets, oil vapors or oil aerosols can pass into all regions of the screw compressor 10.

To reduce the introduction of oil into the air oil separator 42, the introduction of oil into the air oil separator inflow 102 is reduced. This is realized by means of the passage openings 108 of the seal 104, because, owing to the perforated-plate-like structure of the seal 104, less oil 22 can pass to the air oil separator inflow 102. In this way, the introduction of oil into the air oil separator 42 is reduced.

This has the effect that the air oil separator 42 can be configured for smaller oil quantities, because, simply by means of the design of the seal 104, considerable oil quantities can be retained and are captured at the edges of the passage openings 108 and then flow back again on the wall of the seal 104 into the oil sump of the oil 22.

The arrangement of seal 104 and baffle plate 100 furthermore has the function that even horizontal surging movements can be prevented or can be reduced.

The baffle plate 100 and seal 104 thus act as a blockade against horizontal surging movements, in particular in the direction of the air oil separator inflow 102, and thus limit the introduction of oil into the air oil separator 42.

LIST OF REFERENCE SIGNS

10 Screw compressor
12 Fastening flange
14 Input shaft
16 Screws
18 Screws
20 Housing
20*a* Housing body/rotor housing
20*b* Housing cover
22 Oil
24 Inlet connector
26 Air filter
28 Air inlet
30 Valve insert
32 Air feed channel
34 Air outlet pipe
36 Riser line
38 Temperature sensor
40 Holder for an air oil separator
42 Air oil separator
44 Filter screen or known filter or oil separation devices
46 Air outlet opening
48 Check valve
50 Minimum pressure valve
51 Air outlet
52 Riser line
54 Filter and check valve
56 Nozzle
58 Oil return line
59 Oil drain screw
60 Attachment piece
62 Oil filter
64 Oil filter inlet channel
66 Thermostat valve
68 Return line
70 Bearing
72 Nozzle
74 Cooler, heat exchanger
76 Safety valve
78 Bypass line
80 Relief valve
82 Oil level sensor
100 Baffle plate
102 Air oil separator inflow
104 Seal
106 Screw bolt passage opening
108 Passage openings
110 Passage opening
B1 First region
B2 Second region
K1 Compartment
K2 Compartment
K3 Compartment
K4 Compartment

What is claimed is:

1. A screw compressor for a utility vehicle, comprising:
at least one housing with at least one housing cover and with at least one rotor housing;
at least one baffle plate; and
at least one seal,
wherein
in an assembled state, an oil sump is present in the housing,
in relation to the assembled state, the seal is arranged between the housing cover and the rotor housing and projects out of the oil sump,
the seal at least partially separates an interior of the housing cover and an interior of the rotor housing from one another,
in relation to the assembled state, in the case of a substantially horizontal orientation of the screw compressor and in the case of a substantially horizontal orientation of the oil sump, the baffle plate is oriented substantially parallel to an upper level of the oil sump, and
the seal is formed as a plate with perforations at least in regions inside an air space in the housing interior in the assembled state.

2. The screw compressor as claimed in claim 1, wherein the baffle plate has at least one oil passage opening.

3. The screw compressor as claimed in claim 2, wherein the seal divides the housing interior asymmetrically into at least one first region and at least one second region, wherein the first region is smaller than the second region.

4. The screw compressor as claimed in claim 3, wherein the screw compressor has an air oil separator and an air oil separator inflow, the air oil separator inflow opens into the housing interior of the screw compressor, and the passage openings of the seal are arranged in the vicinity of the air oil separator inflow.

5. The screw compressor as claimed in claim 4, wherein the air oil separator inflow is formed in the housing cover.

6. The screw compressor as claimed in claim 3, wherein the air oil separator inflow opens into the first region of the housing interior.

7. The screw compressor as claimed in claim 1, wherein the baffle plate has multiple oil passage openings.

8. The screw compressor as claimed in claim 7, wherein the passage openings are of substantially round form.

9. The screw compressor as claimed in claim 7, wherein the passage openings are of circular form.

10. The screw compressor as claimed in claim 1, wherein the baffle plate and the seal divide the interior of the screw compressor into multiple interconnected compartments.

11. The screw compressor as claimed in claim 1, wherein in relation to the assembled state, in the case of a substantially horizontal orientation of the screw compressor and in the case of a substantially horizontal orientation of the oil sump, the seal is arranged substantially vertically.

12. The screw compressor as claimed in claim 1, wherein the seal has a baffle plate passage opening.

13. The screw compressor as claimed in claim 1, wherein the seal and the baffle plate are plugged one into the other.

14. The screw compressor as claimed in claim 1, wherein the seal and the baffle plate are arranged crosswise with respect to one another.

15. The screw compressor as claimed in claim 1, wherein the seal and the baffle plate are arranged substantially perpendicular to one another.

* * * * *